US005170434A

United States Patent [19]

Anderson

[11] Patent Number: 5,170,434

[45] Date of Patent: Dec. 8, 1992

[54] HEARING AID WITH IMPROVED NOISE DISCRIMINATION

[75] Inventor: James R. Anderson, Chicago, Ill.

[73] Assignee: Beltone Electronics Corporation, Chicago, Ill.

[21] Appl. No.: 722,926

[22] Filed: Jun. 28, 1991

Related U.S. Application Data

[63] Continuation of Ser. No. 459,309, Dec. 29, 1989, abandoned, which is a continuation of Ser. No. 238,207, Aug. 30, 1988, abandoned.

[51] Int. Cl.[5] ..... H04R 25/00

[52] U.S. Cl. ..... 381/68; 381/68.2; 381/68.4

[58] Field of Search ..... 381/68, 68.2, 68.4, 381/71, 93, 94, 98, 95, 101, 106

[56] References Cited

U.S. PATENT DOCUMENTS

| | | | |
|---|---|---|---|
| 3,894,195 | 7/1975 | Kryter | 179/107 |
| 4,072,914 | 2/1978 | Haramoto et al. | 381/98 |
| 4,409,435 | 10/1983 | Ono | 381/71 |
| 4,490,585 | 12/1984 | Tanaka | 179/107 |
| 4,498,060 | 2/1985 | Dolby | 381/106 |
| 4,630,302 | 12/1986 | Kryter | 381/106 |
| 4,736,433 | 4/1988 | Dolby | 381/106 |
| 4,750,207 | 6/1988 | Gebert et al. | 381/68.4 |
| 4,922,535 | 5/1990 | Dolby | 381/106 |

FOREIGN PATENT DOCUMENTS 0240798 3/1987 European Pat. Off. .

OTHER PUBLICATIONS

Technological Reports: Compression Amplification with Environment Controlled Release Time. By; Toni Gitles, MA and Fred A. Wilson, AST.

*Primary Examiner*—James L. Dwyer
*Assistant Examiner*—Jason Chan
*Attorney, Agent, or Firm*—Allegretti & Witcoff, Ltd.

[57] ABSTRACT

A hearing aid that generally provides greater amplification for speech signals than noise signals. The hearing aid includes a microphone, variable highpass filter, transducer, and sensor assembly. The sensor assembly detects the amplitude of a band of low frequencies of the highpass filtered microphone signal, and provides a feedback signal to the variable filter to influence its cutoff frequency based on the characterisics of the highpass filtered microphone signal. The sensor also takes the time characteristics of the signal envelope into account, distinguishing between steady state noise-like signals and dynamically varying signals, such as speech. In response to loud, low frequency, substantially steady state signals, above a threshold amplitude, the sensor provides a feedback signal to the variable filter such that the cutoff frequency is raised. In response to softer, and/or higher frequency, and/or more dynamically amplitude varying signals, the cutoff frequency of the variable filter is raised less or left at a lower value.

2 Claims, 3 Drawing Sheets

10
12
MICROPHONE
14
VARIABLE FILTER
16
22
24
20
THRESHOLD CONTROL
25
26
BP FILTER
18
LEVEL DETECTOR
30
SMOOTHING CIRCUITRY
32

14
.0068
12
34
36
470K
38
20
74
4.7μF
.9V
40
25
10K
48
1.5K
42
.1μF
44
46
24
REC'R
26
30
390pF
58
56
1.2M
32
182K
72
.068
54
22K
52
50
62
5.1K
.22
64
.9V
66
1.2M
68
60
70

HEARING AID WITH IMPROVED NOISE DISCRIMINATION

This is a continuation of application Ser. No. 07/459,309, filed Dec. 29, 1989, now abandoned, which was a continuation of application Ser. No. 07/238,207, filed Aug. 30, 1988, now abandoned.

BACKGROUND OF THE INVENTION

This invention relates to the manufacture of hearing aids. In general, hearing aids receive sound signals and amplify, or otherwise modify, the signals for the hearing aid user. The present invention particularly relates to hearing aids that attempt to amplify speech signals more than noise signals and thus improve the clarity of the signal ultimately provided by the hearing aid to the user.

Electrical circuits for hearing aids circuits are well known. An example of one such hearing aid circuit is described in U.S. Pat. No. 4,792,977 by James Anderson and Richard Brander.

Since hearing aids are worn on or in the human ear, the hearing aid circuitry and battery must necessarily be physically small. Consequently, such circuitry must necessarily be compact and use low levels of power. Nonetheless, the circuitry should also be as complex as necessary to provide a proper signal to help the hearing aid user with his or her particular hearing deficiency.

Many hearing aid users, for example, have difficulty in understanding speech when background noises are simultaneously present. The circuitry for hearing aids used by such persons should attempt to amplify speech signals more than the noise signal. The ability of the hearing aid circuitry to thus "discriminate" between speech and noise, and adjust amplification levels accordingly, significantly improves the effectiveness of the hearing aid and, thus, the hearing ability of the hearing aid user.

Unfortunately, many of the available noise discrimination techniques are poorly suited for use within a hearing aid. Many circuits useful to implement the techniques are physically large or consume significant amounts of electrical power. Other such circuits are simply expensive to manufacture or provide minimal discrimination between speech and noise signals, or have undesirable side effects on the reproduced sound. Prior art devices have used the fact that most noise signals contain high levels of low frequency energy and use the presence of this energy to reduce low frequency amplification if a threshold level is exceeded. Unfortunately, speech also contains significant low frequency energy which may trigger such circuits to reduce low frequency gain even when background noise is not present, reducing naturalness of reproduction.

It would be desirable to take into account the time characteristics of the envelope of the signal to distinguish between steady state noise-like signals and dynamically varying signals, such as speech. This is a feature of the present invention.

Other examples of prior art devices are disclosed in U.S. Pat. Nos. 4,490,585 and 4,409,435.

SUMMARY OF THE INVENTION

In a principle aspect, the present invention is a hearing aid with improved noise discrimination between speech and noise signals. The hearing aid includes a microphone, variable filter, transducer, and sensor assembly. The microphone receives an audible sound signal and responsively provides an electrical microphone signal. The microphone signal exhibits both frequency and amplitude characteristics. The variable filter receives the microphone signal and provides a filtered signal to the transducer. The transducer converts the filtered signal to a sound signal for the hearing aid user.

The sensor assembly detects the amplitude of a range of low frequencies of the filtered signal and responsively provides a feedback control signal to the variable filter. As a result of the feedback control signal, the characteristics of the filter are changed.

Accordingly, when the sensor assembly detects that the filtered signal has characteristics indicating that the hearing aid is in an environment of high noise, the filter blocks a greater proportion of lower frequency signals. Conversely, when the sensor detects a filtered signal which does not have characteristics indicating that the hearing aid in an environment of high noise, the filter allows a greater proportion of low frequency signals to pass on to the transducer.

In another statement of the invention, the sensor assembly includes a sensor filter, level detector, and smoothing circuitry. The sensor filter provides an activating signal in response to low frequency filtered signal supplied by the variable filter. The level detector only provides an activating amplitude signal in response to an activating signal with an amplitude exceeding a predetermined level. The activating amplitude signals from the level detector are then provided to the smoothing circuitry, which, in turn, provides the feedback control signal to the variable filter.

In still another statement of the invention, the smoothing circuitry reacts to the recent historical characteristics of the microphone signal. The smoothing circuitry defines attack and release times which affect the nature of the feedback control signal that the smoothing circuit provides to the variable filter.

As a result of the operation of the sensor assembly, larger amplitude, lower frequency, substantially steady state signals, such as noise, result in the sensor assembly providing a feedback signal that causes the variable filter to block a greater proportion of the lower frequency signals being produced by the microphone. Conversely, small, higher frequency, highly dynamic filtered signals, such as speech, result in a different feedback signal. Such a feedback signal allows the variable filter to pass a higher proportion of low frequency signals on to the transducer.

It is thus an object of the present invention to provide a hearing aid with improved noise discrimination. Another object is a more compact hearing aid that better discriminates between noise and speech and provides greater amplification of speech than noise.

Still another object is a hearing aid that more simply detects the presence of noise and responsively adjusts the frequency response characteristics of the hearing aid. Yet a further object is a hearing aid with improved noise discrimination that uses fewer parts and that is more economic to assemble. Still a further object is a hearing aid with improved noise discrimination characteristics that causes less drain on the hearing aid battery.

These and other objects, features and advantages of the present invention are discussed or apparent in the following detailed description.

BRIEF DESCRIPTION OF THE DRAWING

A preferred embodiment of the present invention is described herein with reference to the drawing wherein.

DETAILED DESCRIPTION OF THE PREFERRED EMBODIMENT

Figure 1:
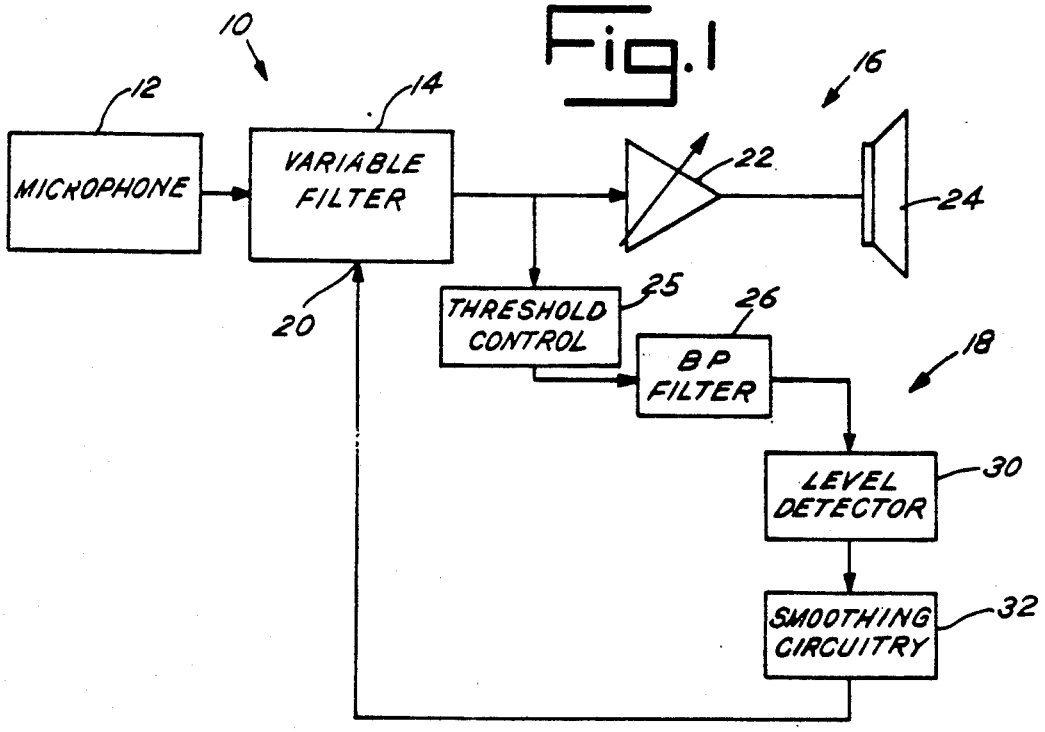
FIG. 1 is a block diagram of a preferred embodiment of the present invention.

Referring to FIG. 1, the preferred embodiment of the present invention is shown as a hearing aid 10. The hearing aid 10 includes a microphone 12, variable filter 14, amplifier-transducer 16, and sensor assembly 18. The microphone 12 receives (information-containing) speech and (non-information containing) noise and responsively provides an electrical microphone signal. The microphone signal exhibits both a frequency characteristic and an amplitude characteristic. The variable filter 14 receives the microphone signal and responsively provides a filtered signal to the amplifier-transducer 16.

The variable filter 14 in the preferred embodiment is a high pass filter with a feedback control input 20. The cutoff frequency of the high pass filter varies according to the control signal received via the control input 20. The variable filter 14 supplies a highpass filtered version of the microphone signals which is the filtered signal.

The amplifier-transducer 16 includes a variable main amplifier 22 and a receiver 24. The main amplifier 22 receives the filtered signal and responsively provides an amplified signal, with a different, typically larger amplitude, to the receiver 24. The receiver 24 receives the amplified signal from the main amplifier 22 and produces an audible sound for the hearing aid user. The amplification of the main amplifier 22 may be adjusted to vary the volume of the sound produced by the hearing aid 10.

The sensor assembly 18 includes a threshold control 25, band pass filter 26, level detector 30, and smoothing circuitry 32. The threshold control 25 allows adjustment of the level below which the sensor assembly 18 will not respond. The band pass filter 26 receives the filtered signal and produces as its output that portion of any filtered signal that has particular characteristics.

In the preferred embodiment, the band pass filter 26 has a center frequency of approximately 250 hertz. Components of the filtered signal in the frequency band around 250 hertz are transmitted to the level detector 30. These components are referred to, for convenience, as the bandpass signal.

The level detector 30 senses whether any portion of the band pass signal from the band pass filter 26 exceeds a particular predetermined amplitude level. If so, the level detector 30 provides an activating signal to the smoothing circuitry 32. The smoothing circuitry 32, in turn, provides a feedback signal to the control input 20 of the variable filter. The feedback signal is dependent upon the recent past history of the filtered signal that the sensor assembly 18 has detected.

Generally, hearing aid users prefer that information-containing sounds, such as speech, be amplified by a hearing aid more than ambient noise. Such ambient noise might include, for example, "babble": the cumulative effect that one encounters when one enters a large room filled with people all talking at once. Although babble is comprised of different voice sounds, the overall effect of all the voices talking at once is to produce noise. If such noise is amplified by the same amount as the sound of a person's voice who is standing adjacent to and talking with the hearing aid user, the hearing aid user may have difficulty distinguishing between the noise (the accumulated sounds of all voices talking at once) and the particular voice that the hearing user wishes to understand.

It has been noted that the reduction of the low frequency response of a hearing aid in such a situation improves the intelligibility of the signal ultimately produced for the hearing aid user. In the preferred embodiment, desired speech signals contaminated with the drone of such babble may be amplified with reduced low frequency response compared to microphone signals associated with noise-free speech.

Applicant has noted that such ambient noise tends to be characterized by microphone signals that are: large (high amplitude); substantially steady state (having an amplitude envelope of a substantially constant level); low frequency (less than 500 hertz). For purposes of illustration only, an example of a hypothetical signal, which could be produced by the microphone 12 when the hearing aid 10 is in the presence of ambient noise, is shown as a first graph at the top of FIG. 2. An example of a hypothetical signal, which could be produced by the microphone 12 when the hearing aid 10 is in the presence of information-containing sound or speech, is shown as a first graph at the top of FIG. 3. The envelope of the signal's amplitude (the waveform which results when successive signal peak values are interconnected) is shown along the vertical axis; time is represented by the horizontal axis.

As shown by the examples of FIGS. 2 and 3, both the noise signal of FIG. 2 and the speech signal of FIG. 3 have the same peak amplitude. For the purposes of the example, it is assumed that both of the microphone signals associated with FIGS. 2 and 3 have approximately the same frequency—under 500 hertz.

Applicant has discovered that, for the microphone signal shown at the top of FIG. 2, the sensor assembly 18 should provide a feedback control signal to the variable filter control input 20 such that the cutoff frequency of the variable filter 14 is moved upward to substantially block the lower frequency components of the microphone signal. For the signal shown at the top of FIG. 3, however, the feedback control signal provided to the control input 20 of the variable filter 14 should cause the variable filter 14 to keep a substantially lower cutoff frequency; this allows most of the lower frequency signal to substantially pass on to the amplifier-transducer 16 and be amplified and produced as an audible sound for the hearing aid user.

The feedback signal provided by the smoothing circuitry 32 is responsive to the historical filtered signals previously provided by the variable filter 14. The smoothing circuitry 32 is substantially slow to increase the feedback signal if, for example, the microphone 12 is at first providing no signal and then begins to send a signal to the variable filter 14. That is, the smoothing circuit 32 has a slow "attack" time. After a low frequency signal has been produced by the microphone 12 for a substantial period of time, however, the smoothing circuit 32 will begin to provide a feedback control signal to the control input 20 of the variable filter 14.

Should the low frequency component of the microphone signal continue, the smoothing circuitry 32 will continue to send a feedback control signal to maintain the cutoff frequency of the variable (high pass) filter 14 at a higher level. If, however, the low frequency component of the microphone signal drops off abruptly, the control signal to the variable filter 14 will drop off smoothly. The time for this drop off to occur is the "release time" of the smoothing circuitry 32 and is fast (relative to the attack time).

Figure 2A:
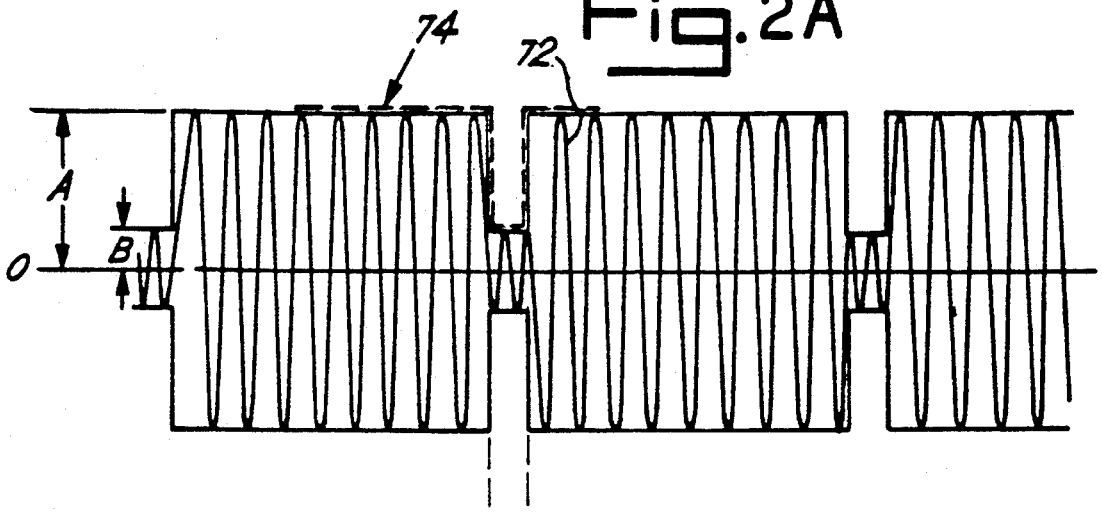
FIG. 2*a* is a first graph, showing a hypothetical example, for illustrative purposes only, of the envelope of a microphone signal produced by the microphone of the hearing aid shown in FIG. 1, where the hearing aid is in the presence of noise.
Figure 3A:
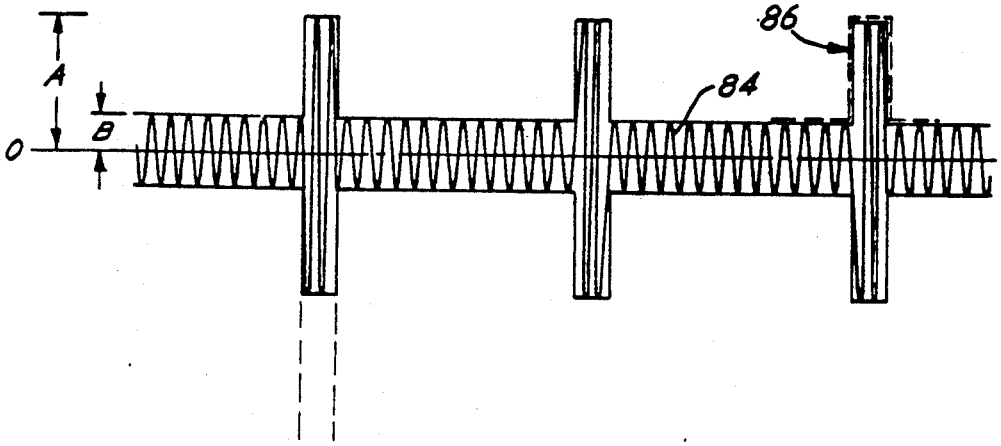
FIG. 3*a* is a first graph, showing a hypothetical example, for illustrative purposes only, of the envelope of a microphone signal produced by the hearing aid shown in FIG. 1, where the hearing aid is in the presence of information-containing sound.

This signal in FIG. 2*a* could be seen as having long periods of constant sound level ("A") with relatively short breaks of lesser amplitude ("B"). This signal is said to have a high "duty cycle" envelope. The duty cycle refers to the time ratio of high amplitude to low amplitude portions of the signal envelope. The signal in FIG. 3*a* has shorter periods of high peak amplitude ("A") and longer periods of lesser amplitude ("B"). This signal has a lower duty cycle envelope. It is not necessary that the signals in FIGS. 2*a* and 3*a* have periodic and well defined amplitude changes as shown. Speech and noise have fairly random amplitude and period characteristics, but the above-described signals represent the type of envelope differences that can occur and better allow understanding of the impact that duty cycle of the envelope has on the output of amplitude detectors with different attack and release time characteristics.

Figure 2B:
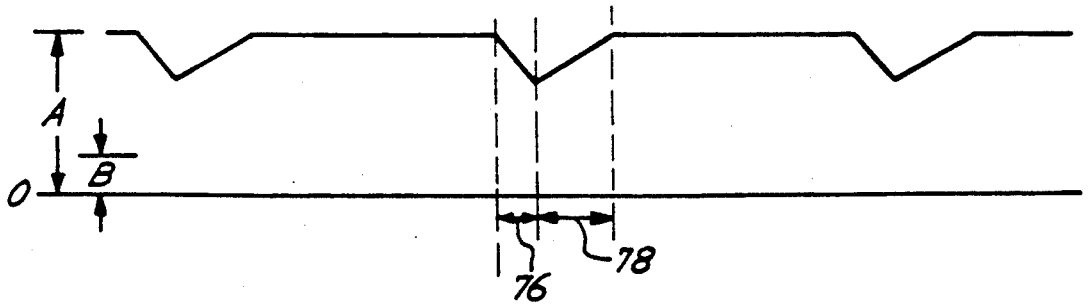
FIG. 2*b* is a second graph, showing an illustrative example of a feedback control signal that the sensor assembly of the hearing aid may produce in response to a filtered signal.
Figure 3B:
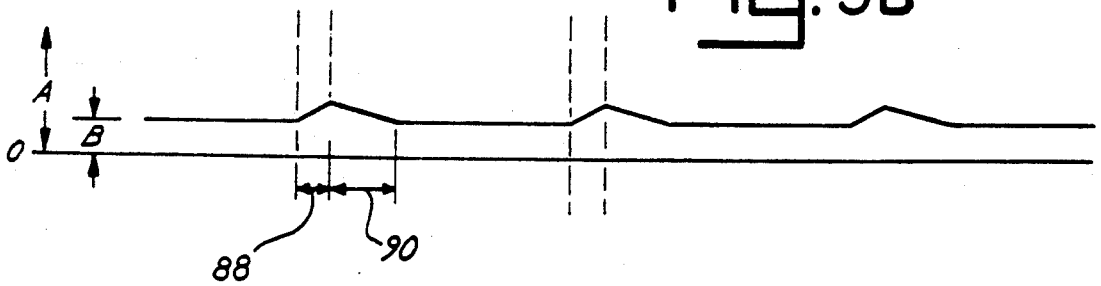
FIG. 3*b* is a second graph, showing an illustrative example of a feedback control signal that the sensor assembly of the hearing aid may produce in response to a filtered signal.

Such feedback control signals are graphically displayed by the second, middle graphs in FIGS. 2*b* and 3*b*. In FIG. 2*b*, for example, the feedback control signal stays substantially high (near "A"), maintaining the variable cutoff frequency of the variable filter 14 at a high position. For the case shown in FIG. 3*b*, however, the feedback control signal is substantially less than the feedback control signal shown in FIG. 2*b*. As a result, the cutoff frequency is kept at a substantially lower level. Consequently, a greater proportion of the low frequency signal associated with the example of FIG. 3 is passed on to the amplifier-transducer 16.

In typical Automatic Gain Control systems, attack times are short compared to release times. This results in essentially a peak detection system. If such a conventional AGC system were used, the recovered filtered control voltage would tend to follow the peaks of the microphone signal envelope.

Figure 2C:
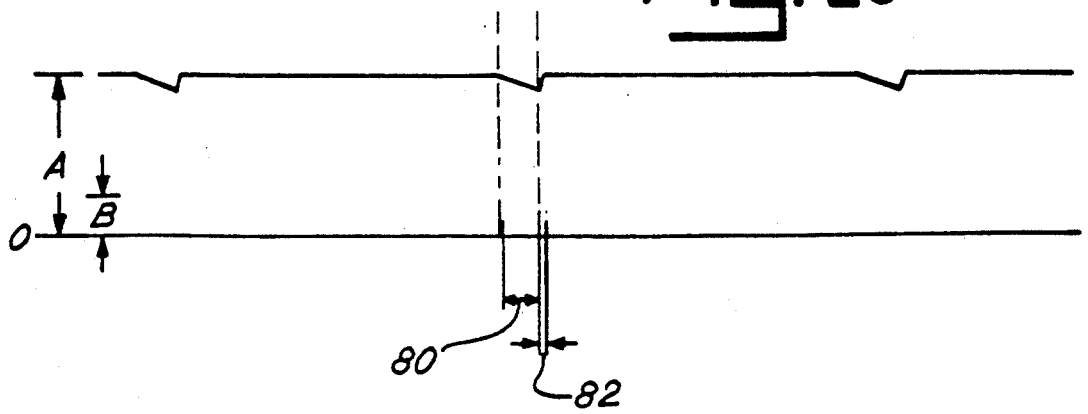
FIG. 2*c* is a third graph showing an illustrative example of a feedback control signal that may be produced by a prior art hearing aid in response to a filtered signal.
Figure 3C:
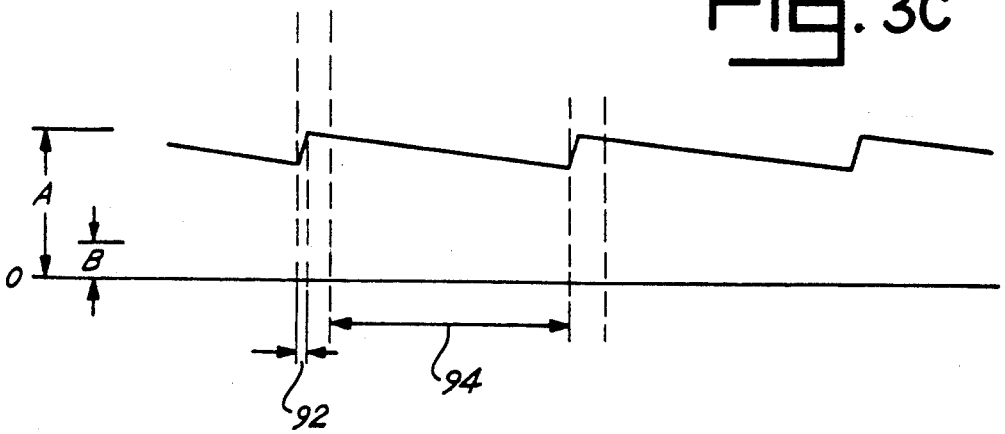
FIG. 3*c* is a third graph showing an illustrative example of a feedback control signal that may be produced by a prior art hearing aid in response to a filtered signal.

This is shown, for illustrative purposes only, in FIGS. 2*c* and 3*c*. Applicant has noted, however, that if the attack time is increased relative to the release time, the control voltage will tend to follow closer to the minimum values of the envelope of the control voltage and allow the hearing aid 10 to discriminate between speech and noise and provide more low frequency reduction for noise than for speech with the same peak amplitude as the noise.

Figure 4:
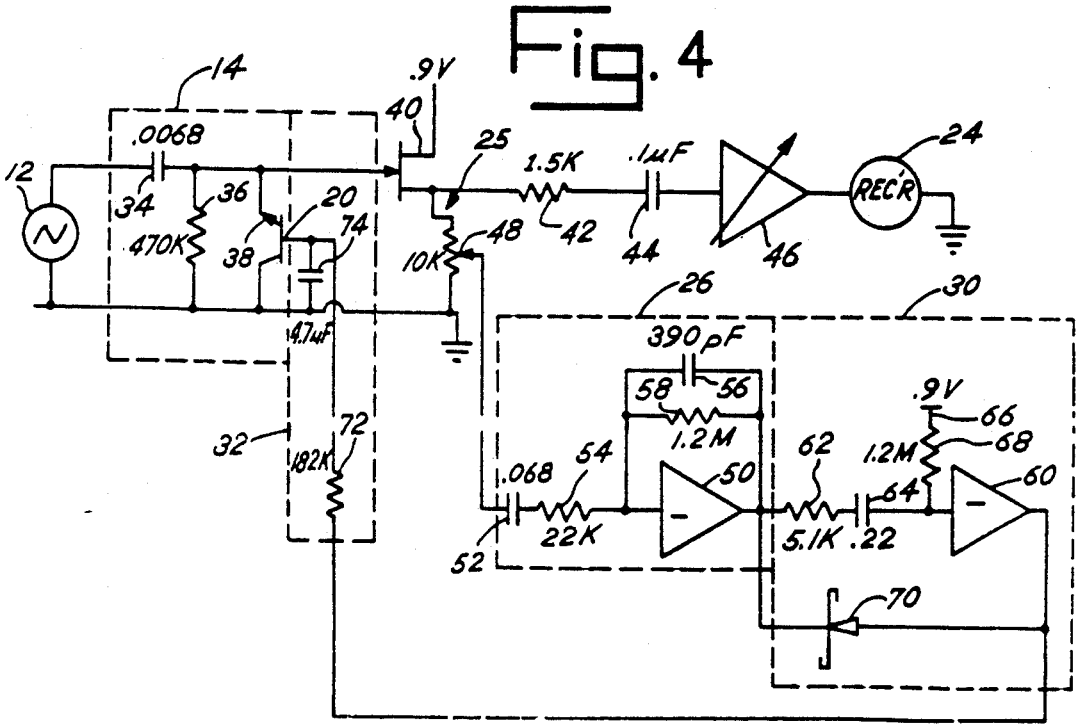
FIG. 4 is a schematic diagram of the preferred embodiment shown in FIG. 1.

As shown in FIG. 4, the variable filter 14 is of a standard construction with a capacitor 34, resistor 36, and transistor 38. The transistor 38 is an NPN transistor, connected with inverse polarity to its normal configuration. (This produces less DC offset voltage across the collector and emitter terminals of the transistor 38.) The transistor 38 includes a base that defines the feedback control input 20.

The transistor 38 is connected in parallel to the resistor 36. Thus, when the operating state of the transistor 38 moves towards a fully ON state, the resistor 36 is shunted by the reduced collector to emitter impedance of transistor 38 and the cutoff frequency of the variable (high pass) filter 14 is moved upward. Conversely, when the transistor 38 is turned OFF, the resistor 36 is not shunted, and the cutoff frequency of the variable filter 14 is at a lower level.

The amplifier-transducer 16 includes an FET source follower 40, a gain setting resistor 42, a DC blocking capacitor 44, a variable gain main amplifier 46, and the receiver 24. The transistor 40 provides impedance buffering between the variable filter 14 and the rest of the circuit. The resistor 42 sets the gain of the amplifier 46, and the capacitor 44 blocks the DC component of the source follower 40 from the main amplifier 46.

The threshold control 25 in the sensor assembly 18 includes a potentiometer 48. The potentiometer 48 may be manually adjusted to change the sensitivity of the sensor assembly 18.

The band pass filter 26 includes an inverting amplifier 50 together with a first capacitor and resistor 52, 54 and a second capacitor and resistor 56, 58. The first capacitor and resistor 52, 54 establish the lower cutoff frequency of the band pass filter 26, and the second resistor and capacitor 56, 58 establish the higher cutoff frequency of the filter 26. The resistors 58 and 54 establish the gain of the band pass filter in the pass band. In the preferred embodiment, the filter 26 has a center frequency of approximately 250 hertz: signals with a frequency between approximately 100 and 350 hertz are transmitted through the band pass filter 26 to provide the band pass signal to the level detector 30.

The level detector 30 includes an inverting amplifier 60, a first resistor 62, a capacitor 64, a 0.9 volt source of power 66, a second resistor 68, and a Schottky diode 70. The first resistor and capacitor 62, 64 apply the bandpass signal to inverting amplifier 60. Capacitor 64 provides DC blocking. When the bandpass signal current drawn through the resistor 62 exceeds the current supplied by 0.9 V source 66 through resistor 68 the inverting amplifier 60 provides an activating amplitude signal to the smoothing circuitry 32. The Schottky diode 70, connected between the output and input of the level detector 30, clamps the output to approximately within 0.3 volt of the input, making the level detector 30 less responsive to variations in the battery voltage of the hearing aid 10.

The smoothing circuitry 32 only receives an activating signal when the filtered signal has reached a particular amplitude, as established by the level detector 30. The smoothing circuitry 32 includes an RC circuit comprised of a resistor 72 and capacitor 74.

The smoothing circuitry 32 receives the activating signal and responsively provides the feedback signal to the feedback control input 20 of the variable filter 14. The output of the smoothing circuitry 32 has an attack time of approximately 1 second and a release time of approximately 300 milliseconds. Applicant has noted that in the preferred embodiment, the release time is preferably less than half as long as the attack time. Accordingly, the feedback signal applied to the feedback control input 20 may correspond, in general, to the graphs of FIGS. *2b* and *3b*.

Consequently, the smoothing circuitry 32 transmits larger feedback signals to the feedback control input 20 for more steady state microphone signals (such as a noise signal), as compared to a microphone signal with the same peak amplitude but with more dynamically varying amplitude (such as a speech signal). The greater feedback signal developed for the noise signal relative to the speech signal would result in the cutoff frequency of the variable filter 14 being moved higher for the noise signal, resulting in greater attenuation of low frequency response of the hearing aid 10. A speech signal with the same peak amplitude could experience less low-frequency attenuation.

A preferred embodiment of the preferred invention has been described herein. It is to be understood, of course, that changes and modifications may be made in the embodiment without departing from the true scope and spirit of the present invention, as defined by the appended claims.

I claim:

1. A hearing aid comprising, in combination:

a microphone for receiving a signal and responsively providing an electrical microphone signal, said microphone signal exhibiting both frequency and amplitude characteristics;

a variable filter for receiving said microphone signal, said variable filter having high pass characteristics and defining a cutoff frequency, said variable filter also having a feedback control input for receiving a feedback control signal and responsively varying said cutoff frequency, said variable filter providing a filtered signal exhibiting both frequency and amplitude characteristics;

a transducer for receiving said filtered signal and responsively providing a sound; and sensor means for responding to frequency characteristics and temporal historical amplitude characteristics of said filtered signal and responsively providing said feedback control signal to said feedback control input of said variable filter, said sensor means further providing a larger feedback control signal for substantially steady state signals than for amplitude-varying signals having substantially equivalent peak envelope values, said sensor means including a feedback filter for receiving said filtered signal and providing a secondary filtered signal in response to at least a portion of said filtered signal having a frequency below a predetermined value, a level detector for receiving said secondary filtered signal and providing an activating signal in response to said secondary filtered signal having an amplitude above a predetermined level, and smoothing means for providing said feedback control signal to said variable filter in response to said activating signal from said level detector, said variable filter capable of raising said cutoff frequency above said predetermined value, said sensor means and variable filter cooperatively defining both an attack and a release time, said attack time being greater than said release time.

2. A hearing aid as claimed in claim 1 wherein said smoothing means and level detector cooperatively define both a rise time and a fall time and said rise time is greater than said fall time.

* * * * *